US005478299A

United States Patent [19]

Harmon et al.

[11] Patent Number: 5,478,299

[45] **Date of Patent: *Dec. 26, 1995**

[54] ADAPTABLE EXERCISE APPARATUS

[76] Inventors: Larry S. Harmon, P.O. Box 1706; Janet S. Esty, 2962 Estates Dr., both of Park City, Utah 84060

[ * ] Notice: The term of this patent shall not extend beyond the expiration date of Pat. No. 5,320,591.

[21] Appl. No.: 259,037

[22] Filed: Jun. 13, 1994

Related U.S. Application Data

[63] Continuation-in-part of Ser. No. 41,833, Apr. 1, 1993, Pat. No. 5,320,591, which is a continuation-in-part of Ser. No. 698,399, May 10, 1991, abandoned.

[51] Int. Cl.[6] ..... A63B 21/04

[52] U.S. Cl. ..... 482/129; 482/121; 482/133

[58] Field of Search ..... 128/25 R; 482/141, 482/142, 148, 121–123, 128, 129, 130, 133, 135, 907, 904, 111–119, 92, 38–42

[56] References Cited

U.S. PATENT DOCUMENTS 2,223,309 11/1940 Swanson ..... 482/123
4,517,966 5/1985 von Othegraven ..... 482/128
5,071,119 12/1991 Johnson ..... 482/128
5,320,591 6/1994 Harmon et al. ..... 482/121

*Primary Examiner*—Richard J. Apley
*Assistant Examiner*—Jerome Donnolly
*Attorney, Agent, or Firm*—Thorpe, North & Western

[57] ABSTRACT

A resistance exercise apparatus is provided which comprises generally means for receiving a body extremity of a user, the means for receiving a body extremity subject to a force provided by the body extremity, this force resulting in limited movement of the means for receiving a body extremity; means for maintaining the means for receiving a body extremity in a predefined plane during movement; and a means for providing resistance to movement upon application of the force to the means for receiving a body extremity. The apparatus may include a self supporting base portion, or may be adaptable for temporary connection for a bed. This apparatus, both portable and stationery versions, combines the well-known resistance methods of isometrics and isotonics to provide a more efficient exercise. Resistance is provide within a single plane by an elastic cord or by a fluid device.

22 Claims, 11 Drawing Sheets

ADAPTABLE EXERCISE APPARATUS

RELATED APPLICATIONS

This application is a continuation-in-part of U.S. Ser. No. 08/041,833 now U.S. Pat. No. 5,320,591 filed Apr. 1, 1993 of Larry S. Harmon and Janet S. Esty entitled Versatile Exercise Apparatus which is a continuation-in-part of U.S. Ser. No. 07/698,399 now abandoned filed May 10, 1991 of Larry Shane Harmon entitled Exercise Apparatus.

BACKGROUND

1. The Field of the Invention

This invention relates generally to exercise apparatus and more specifically to a novel apparatus for exercising which combines the principles of isometrics and isotonics.

2. The Prior Art

Increasingly, individuals and groups are becoming conscientious of exercising and other health related habits, and making substantial efforts to improve the same. Responsive to this increased awareness, the health and physical fitness industries have grown tremendously in the last several years. New exercise products are being introduced continuously.

Virtually all resistance-type exercise devices and apparatus use one of three basic resistance principles. The first of these is isometrics, which is a static form of exercise wherein the joints are moved at a constant speed (0 degrees per second) against a constant resistance, that is, with no observable joint movement. For example, pushing the palms of the hands against one another is an isometric exercise. Studies indicate that isometric exercise increases strength primarily at the specific angle assumed by the joint when force is applied.

The second form of resistance is isotonics and involves movement of a joint throughout a range of motion against a constant resistance. The best example of isotonic exercise is the use of barbells or similar free weights. With traditional isotonics, there is no way to accommodate for biomechanical leverage changes that increase and decrease muscular efficiency throughout the range of motion. Therefore, the dynamically contracting muscle is only loaded maximally at its weakest point in the range of motion.

The third basic type of resistance exercise is isokinetics and entails exercise performed at a constant speed with totally accommodating resistance throughout the entire range of motion. This form of exercise requires specially designed, complex, and expensive equipment, and usually requires constant supervision. Therefore, exercise apparatus utilizing the principle of isokinetics are generally not well suited to the individual who may wish to exercise within the confines of his own home or who cannot afford the great expense of such apparatus.

While a great number of exercise devices and apparatus are known which utilize either the isometric or isotonic method of exercise, there does not appear to be any apparatus in the exercise or therapy field which combines these two principles. A great advantage would be gained thereby, since both of these principles have distinct advantages. For example, isometric exercises provide the following important advantages: less joint irritation since there is no joint motion, increase of static muscular strength, reduction in swelling of joints, and isometric exercises can be performed anywhere in relatively short periods of time.

Similarly, some of the advantages of isotonic exercises are: ready availability, provides motivation by achievement (the user is able to lift more weight as muscles are strengthened), improves muscular endurance, is objectively documentable, and increases muscular strength with relatively few repetitions.

In addition to combining these desirable advantages, an exercise apparatus utilizing both isometrics and isokinetics would obviate the above-mentioned problem associated with isotonic exercise of maximally loading the dynamically contracting muscle at only its weakest point. Instead, the apparatus could be adjusted such that maximal loading could occur at any of the several points along its limited range of motion. Thus, it becomes clear that an exercise apparatus combining the advantages of both isometric and isotonic exercise would be a great advance in the art. Moreover, such an apparatus would have great benefits as a physical therapy device for use by those who have suffered an injury or who have reduced capacity for exercise.

BRIEF SUMMARY AND OBJECTS OF THE INVENTION

In view of the above described state of the art, the present invention seeks to realize the following objects and advantages.

A principle object of this invention is to provide a combined isometric/isotonic resistance exercise apparatus providing the advantages inherent in both of these resistance methods.

It is also an object of the present invention to provide an exercise apparatus which is adaptable to a variety of different circumstances and user conditions.

It is another object of the invention to provide an exercise apparatus which is self-contained and adjustable to provide many different exercises, each exercise focusing on different muscle groups.

It is yet another object of the present invention to provide an exercise apparatus which is lightweight and portable.

It is still another object of the present invention to provide an exercise apparatus which is easily manufactured and relatively inexpensive.

It is a further object of the present invention to provide an exercise apparatus which is efficient, durable, easily assembled, and operable by one user without assistance from another person.

These and other objects and advantages of the invention will become more fully apparent from the description and claims which follow, or may be learned by the practice of the invention.

Accordingly, the exercise apparatus of the present invention comprises generally means for receiving a body extremity, said means for receiving a body extremity receiving a directional force provided by the body extremity, said force resulting in limited movement of the means for receiving a body extremity; means for maintaining the means for receiving a body extremity in a predefined plane during movement; and means for providing resistance to movement upon application of the force to the means for receiving a body extremity.

At present preference, the means for receiving a body extremity comprises a horizontally disposed bar to be grasped or otherwise contacted by a body extremity, such as a hand. Alternatively, for example, one or more slings is provided into which a body extremity is inserted.

A preferred means for maintaining the means for receiving a body extremity in a predefined plane during movement comprises a cylindrical sleeve securely attached to each end of the horizontally disposed bar, each sleeve being slidably mounted on a vertically disposed post. The two posts combine to form a plane within which movement of the bar is limited. It will be appreciated that the predefined plane can be either flat or curved. In the event that slings are used in place of the horizontally disposed bar, each sling is securely attached to one of the sleeves. Additionally, the slings can be used in cooperation with the horizontally disposed bar, e.g., attached thereto.

The means for providing resistance preferably comprises a cord formed of a material exhibiting elastic properties which is securely attached near the bottom and top end of each vertically disposed post. In order to provide the desired resistance, each cord must be maintained in a taut configuration. Further, each cord is securely attached near its midsection to one of the sleeves slidably mounted on the vertically disposed posts. In this manner, the horizontally disposed bar, or, in the alternative, each sling or other body part receiving structure, is secured in place.

This invention may also include a support structure, depending upon the intended use thereof. For example, the apparatus may be self supporting and include a bench or chair upon which the user sits or lays. Such free-standing embodiments of the present invention may be adapted to provide access to a wheelchair so that person confined to the wheelchair can obtain the advantages of the invention. Alternatively, the apparatus may be adapted for connection to a standard hospital bed so that a person confined thereto can also obtain the advantages of the invention.

In one example of use of the present invention, the user grasps the bar or slings, or otherwise contacts the same, and exerts a force. The vertical position of the bar can be varied to accommodate different positions for a body extremity. The bar or slings may be pushed or pulled upwardly or downwardly by a variety of body extremities or parts, as desired, to work the muscle group to be exercised. Responsive to the force exerted, the bar or sling will move only slightly within the plane defined by the vertically disposed posts. By limiting the movement of the bar or slings to a slight distance, regardless of the force exerted, the benefits of both isometric and isotonic resistance exercises are effectively combined.

These and other objects and advantages of the invention will become more fully apparent from the description and claims which follow, or may be learned by the practice of the invention.

BRIEF DESCRIPTION OF THE DRAWINGS

In order to better appreciate how the above-recited and other advantages and objects of the invention are obtained, a more particular description of the invention briefly described above will be rendered by reference to a specific embodiment thereof which is illustrated in the appended drawings. Understanding that these drawings depict only a typical embodiment of the invention and are not therefore to be considered limiting of its scope, the invention will be described and explained with additional specificity and detail through the use of the accompanying drawings in which.

DETAILED DESCRIPTION OF THE PREFERRED EMBODIMENTS

Reference will now be made to the drawings wherein like structures will be provided with like reference designations.

Figure 1:
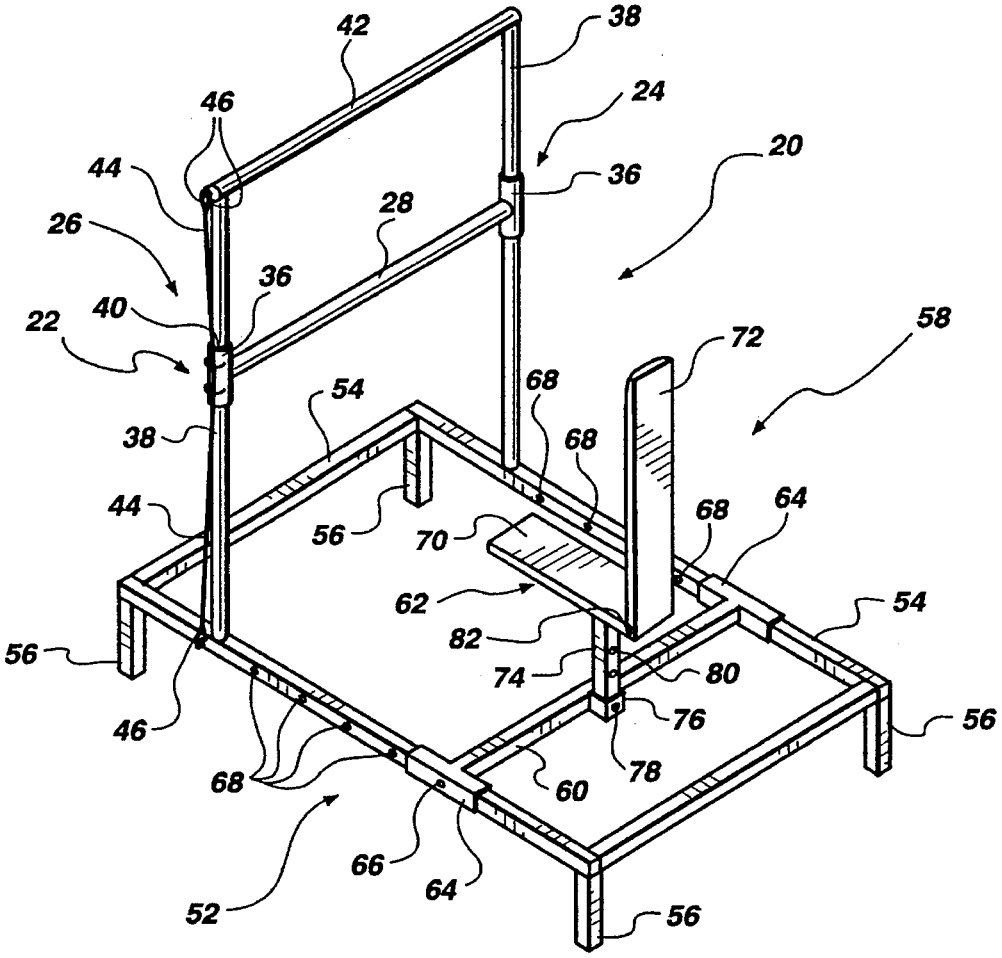
FIG. 1 is a perspective view of a presently preferred embodiment of the present invention intended for general purpose use.

Reference is now made to the drawings in which like components are designated with like reference numbers throughout. Referring first to FIG. 1, a first presently preferred embodiment of the present invention, generally designated 20, is illustrated. The embodiment of FIG. 1 comprises one example of a means for receiving a body extremity of a user 22. The structures generally designated at 22 function as one presently preferred example of a means for receiving a body extremity of a user. The means for receiving a body extremity is subject to a force provided by the user (e.g., by an arm or a leg) and this force results in limited movement of the means for receiving a body extremity 22.

Also illustrated in FIG. 1 is one preferred structural arrangement of a means, comprising the structures generally Thorpe, North & Western designated at 24, for maintaining the means for receiving a body extremity 22 in a predefined plane during movement. In the illustrated embodiments, such movement is limited to a flat predefined plane but may also include curved planes or a flat plane oriented at a nonvertical angle.

Also shown are representative structures, generally designated 26, functioning as a means for providing resistance to movement upon application of the force to the means for receiving the body extremity 22. Each of these components will be described in greater detail hereafter.

Figure 3:
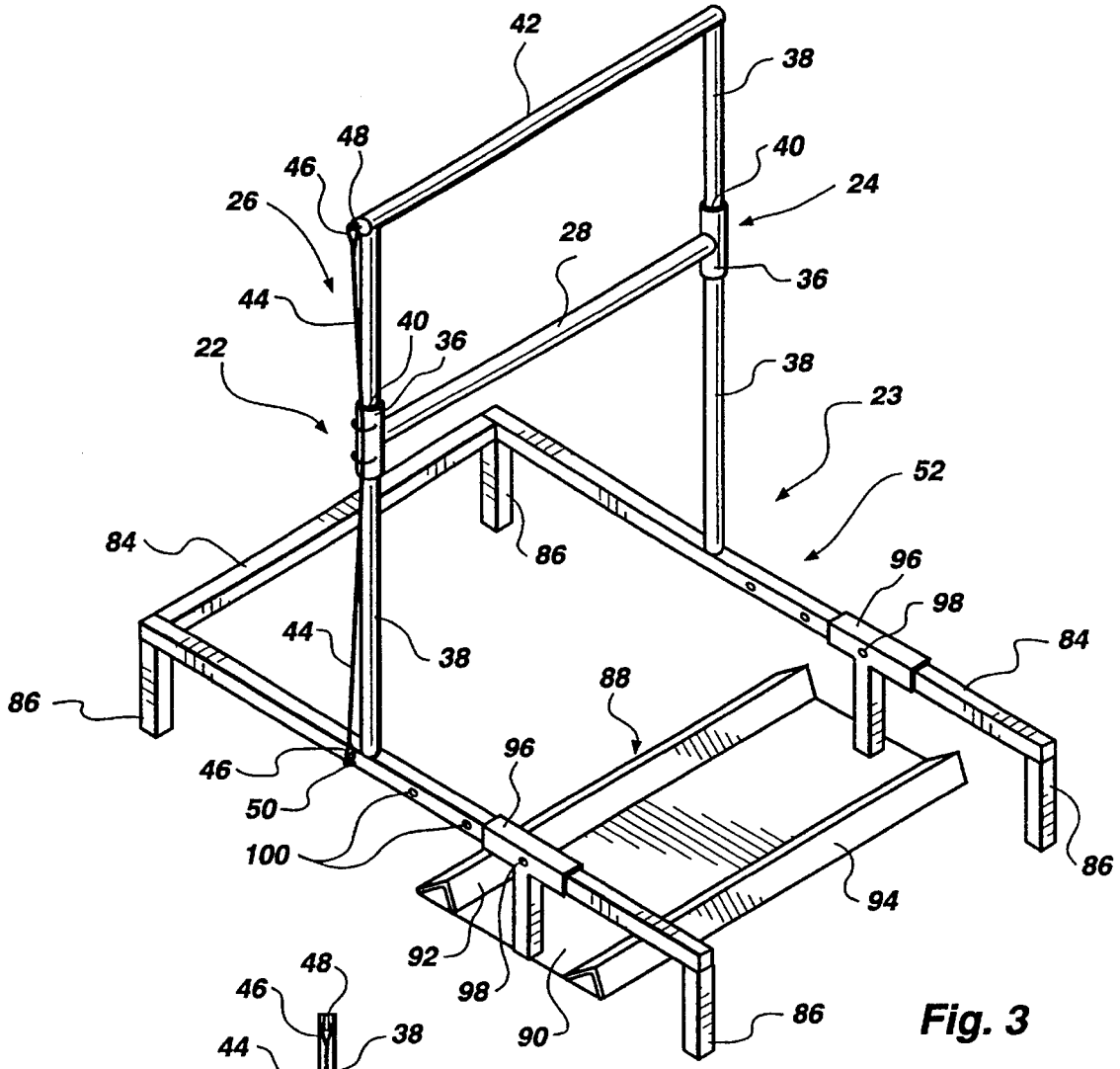
FIG. 3 is a perspective view of another preferred embodiment of the present invention adapted specifically for users confined to a wheelchair.

The means for receiving a body extremity of a user 22, in its preferred form, is a rigid horizontal bar 28, which is formed of a suitable strong and rigid material. As shown in FIGS. 1 and 3, the bar 28 has two ends, both ends being securely attached to the sleeve 26 which function as part of the means for maintaining the means for receiving a body extremity in a predefined plane during movement.

Figure 6:
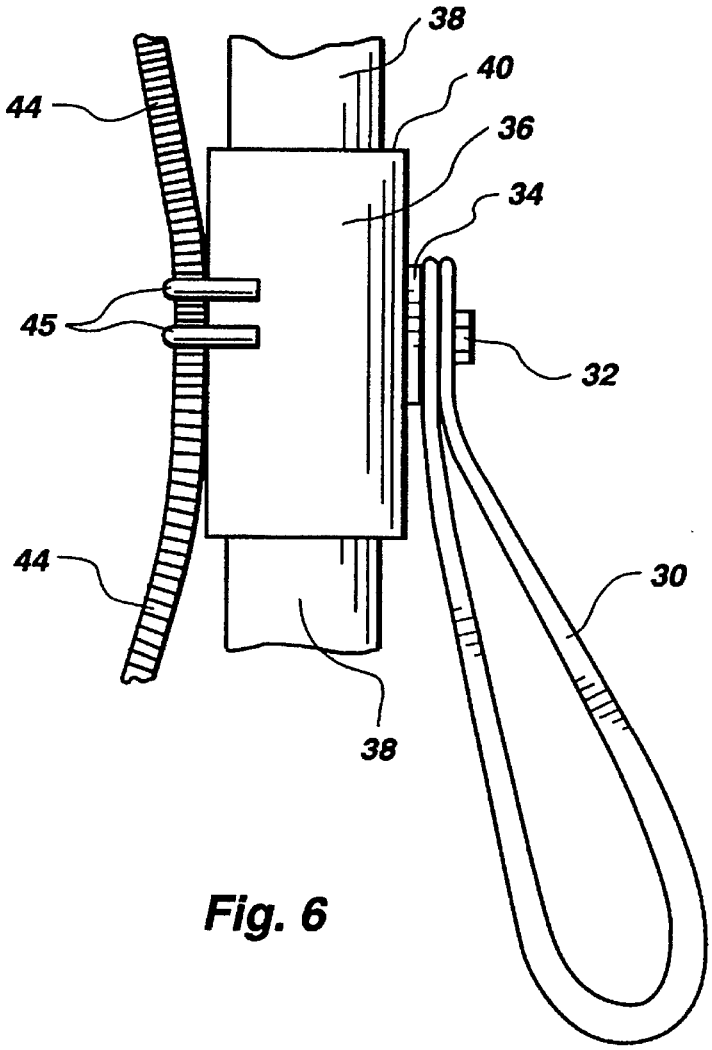
FIG. 6 is an enlarged elevational fragmentary view illustrating attachment of the flexible and elastic cord to a slidable sleeve.

Alternatively, the means for receiving the body extremity may be carried out by at least one sling 30 into which a body extremity can be inserted. FIG. 6 illustrates the sling 30 as being attached to a sleeve 36 as explained hereafter. Attachment thereof may be made by a bolt 32 in combination with a washer 34, the bolt 32 passing through apertures, not shown, formed in both ends of the sling 30, as well as through the washer 34. Alternatively, the sling 30 may be slidably attached to the rigid crossbar 28.

Those skilled in the art will recognize that the sling 30 may be attached in any of a number of different ways to the means 24, and that the attachment assembly shown in FIG. 6 is merely illustrative. Similarly, one skilled in the art will recognize that the means for receiving a body extremity of a user may have a different form than the bar 28 or the sling 30, without departing from the scope of this invention. For example, a rigid handle attached to a supporting structure on one of its ends may also be used within the scope of the present invention.

In the illustrated embodiments, the means for maintaining the means for receiving a body extremity in a predefined plane during movement further limits such movement to one dimension. In other embodiments, it may allow movement in a curved plane. The preferred structures for carrying out the means for maintaining the means for receiving a body extremity in a predefined plane during movement is best shown in FIGS. 1 through 6. In the illustrated embodiments, the means for maintaining comprises two sleeves 36 attached to the rigid bar 28 (which functions as a means for receiving a body extremity) and a post 38 upon which each sleeve 36 is slidably mounted.

As shown, each sleeve 36 is preferably cylindrical in shape and includes a hollow central portion 40. The post 38 upon which each sleeve 36 is slidably mounted passes through the central portion 40 of the sleeve 36. The posts 38 are generally oriented in an upright position, and preferably disposed vertically to provide a vertical range of motion, and parallel, thus defining a flat plane. It is also within the scope of the present invention to dispose the posts 38 at an angle other than vertical.

Each of the two parallel posts 38 is formed of a rigid material, for example a metal, and should have a fairly smooth exterior surface such that the sleeve 36 mounted on each post 38 slides freely thereon. The posts 38 may be characterized as including top, middle and bottom portions. The bottom portions of each post 38 are preferably fixedly attached to a base, as detailed hereafter.

Figure 7:
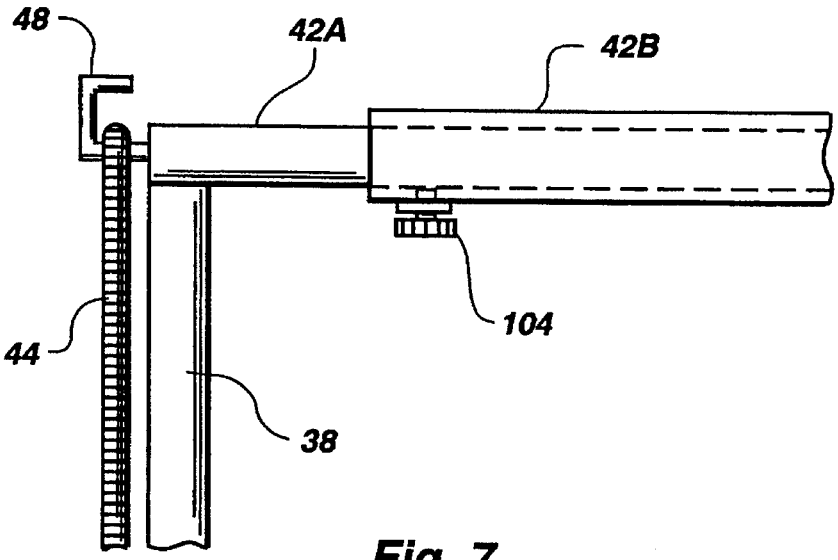
FIG. 7 is an enlarged elevational fragmentary view, according to the embodiment represented in FIG. 5, illustrating the attachment of the flexible and elastic cord near the top of a vertical post and further illustrating the securing of telescoping cross members after adjustment thereof.

In the illustrated embodiments, a crossbar 42 connects the top portions of the two parallel posts 38 together. The crossbar 42 has two ends, one end being fixedly attached to the top portion of each of the posts 38. This connection may be made in any manner known in the art. As shown in FIG. 7, the preferred connection is made by a weld joining the post 38 and the crossbar 42.

Each sleeve 36 should be rigid and sized so as to accept one of the posts 38 in the hollow central portion 40 thereof in a snug, but not tight, slidable relationship. It will be apparent to one skilled in the art that the two upright parallel posts 38, in combination with the sleeves 36, define a flat plane within which movement of the attached means for receiving a body extremity, i.e., rigid bar 28, is limited.

Also included in the embodiments of the present invention is a means for providing resistance to movement of the body extremity. As shown in the drawings, the preferred component for carrying out this function is formed from an elongated piece of material exhibiting elastic properties, such as a flexible cord 44. Other materials and devices, such as a sheet of elastic material or even a pneumatic or hydraulic device (either actively driven or passive), are contemplated to function as flexible cord 44 and fall within the purview of this invention. For example, passive pneumatic devices which can preferably be used within the scope of the present invention are known in the industry as BIMBA stainless steel air chambers Model no. 094-D and air release valves manufactured by SMC and designated no. AS2200 can also preferably used therewith. Another preferred structure for providing resistance to movement is the flexible cord 44 which in one form is commonly referred to as "surgical tubing." Moreover, all of the described resistance providing structures have the advantage of being unitary structures which provide resistance in two directions, in contrast to two independent devices which each provide resistance in only one direction, e.g., springs.

It will be apparent that the resistance to movement provided by the flexible cord 44 is determined by the diameter thereof. The flexible cord 44 is pulled to a desired tautness and the first end of the flexible cord 44 is connected to or near the top portion of a post 38 and the second end of the flexible cord 44 is connected to the bottom portion of a post 38, as shown in FIG. 5. Alternatively, the second end of the flexible cord 44 is connected to a base, such as shown in FIGS. 1 through 4 and described hereafter.

Importantly, some portion of the flexible cord 44 is connected to the sleeve 36. If desired, clamps 45 may be arranged so that they releasably grip the flexible cord 44. This will allow the position of the sleeve 36 relative to the length of the flexible cord to be adjusted. In some circumstances, e.g., accommodating differing size users, adjusting the relative position of the sleeve 36 and the flexible cord 44 will be advantageous.

Figure 8:
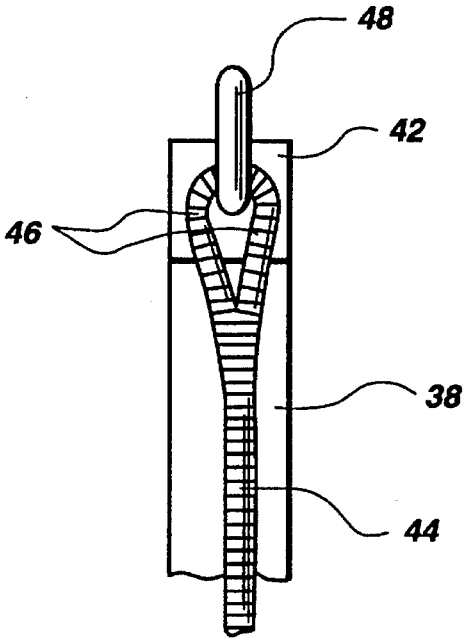
FIG. 8 is an enlarged elevational fragmentary view of the preferred manner in which the flexible and elastic cord is attached near the top of a vertically disposed post.
Figure 9:
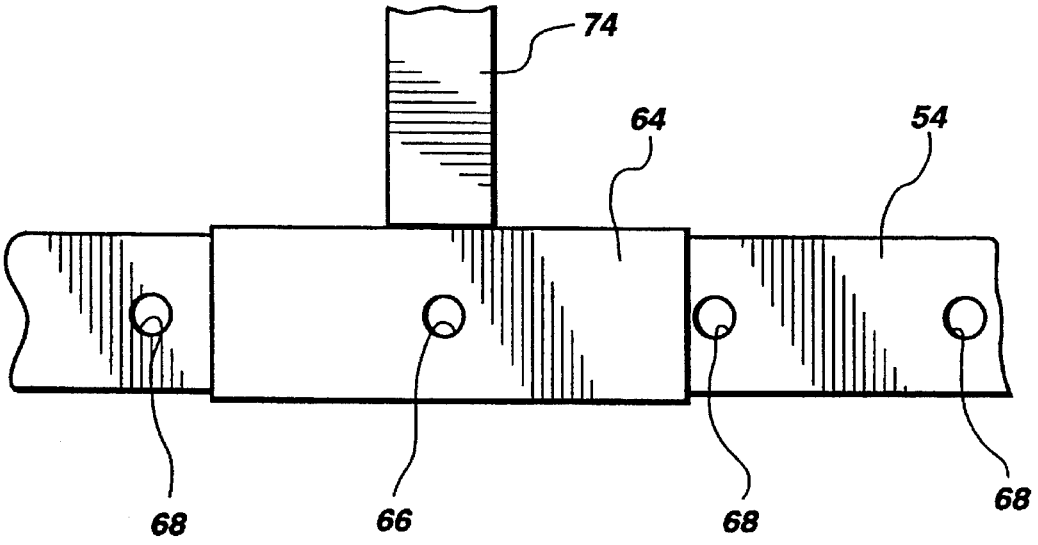
FIG. 9 is an enlarged elevational fragmentary view of the structures which can preferably be used to allow the components of the illustrated embodiments to be adjustably positioned.

FIGS. 6 through 8 illustrate a preferred flexible cord 44 and the manner in which it is attached to the post 38 and the sleeve 36, as mentioned. Both the first and second ends of the cord 44 comprise an integrated loop 46 (FIG. 8), although it should be recognized that the loop 46 may be formed in any manner known in the art. As shown, hooks 48 and 50 are securely attached, as by welding, near the top of each post 38, preferably to the crossbar 42, and bottom portion of each post 38, respectively. Alternatively, as shown in FIGS. 1 through 4, the bottom hook 50 may be fixedly attached to a base, described later herein.

Importantly, the middle portion of the flexible cord 44 is attached to a sleeve 36. See FIG. 6. With the top and bottom end portions of the cord 44 looped about top and bottom hooks 48 and 50, respectively, and the middle portion of the cord 44 attached to a sleeve 36, the rigid bar (28 in FIG. 1) or the sling (30 in FIG. 6), which function as means for receiving a body extremity, is held in place ready to receive a body extremity. The flexible cord 44 provides resistance to movement upon application of a force to the means for receiving a body extremity.

Figure 2:
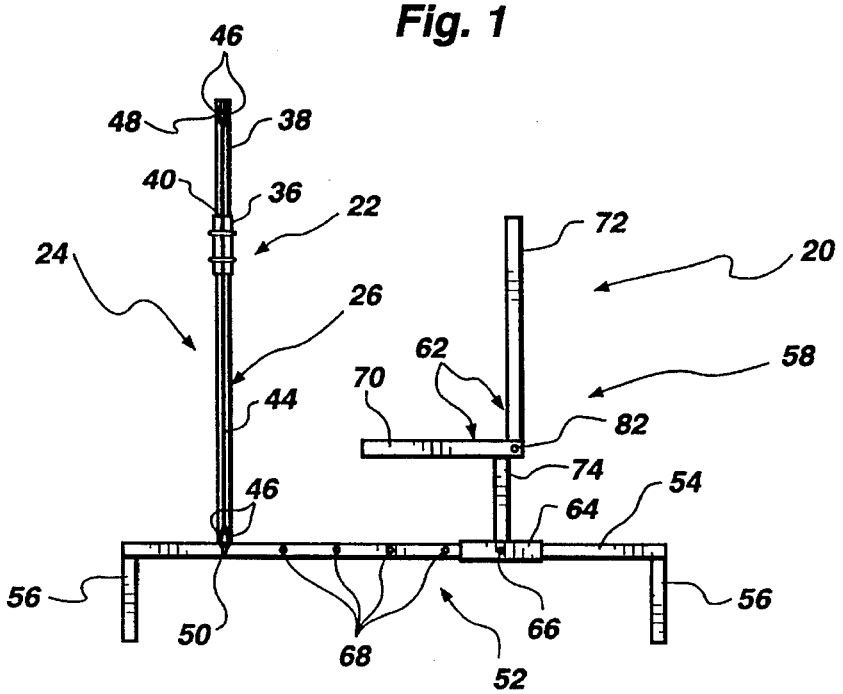
FIG. 2 is a side elevational view of the embodiment represented in FIG. 1.

Referring now to FIGS. 1 and 2, the apparatus 20 includes structural means such as a base, generally designated at 52, which is self supporting. The base 52 of FIGS. 1 and 2 is formed of a rigid material and comprises a rectangular frame portion 54, a supporting leg 56 disposed at each corner of the rectangular frame portion 54, and an adjustable positioned assembly, generally designated at 58, for maintaining the user in a proper position relative to the other structures of the embodiment.

The adjustable positioned assembly 58 comprises a cross member 60 which is slidably mounted to opposing members of the frame portion 54, and an adjustable seat, generally designated at 62, upon which the user may sit or lay during operation of the illustrated apparatus. In the preferred embodiment, the cross member 60 includes integrated sleeves 64 through which opposing members of the frame portion 54 pass, similar to the relationship between each sleeve 36 and post 38.

In this manner, the position of the user is adjustably positioned relative to the bar 28 or slings 30 to allow the user to contact and provide a force against the bar 28 or slings 30, the force preferably resulting in no more than slight movement of the bar 28 or sling 30. As illustrated, each integrated sleeve 64 may include an aperture 66 which at certain positions corresponds, to one of a series of apertures 68 drilled or otherwise formed in the opposing members of the frame portion 54 to which the cross member 60 is mounted. A pin, or other similar well-known implement, not shown, may then be passed through aligned apertures 66 and 68 to secure the crossbar 60 in place during use.

The adjustable positioned assembly 58, shown in FIGS. 1 and 2, further comprises the adjustable seat, 62, which includes a pair of seat members 70 and 72 which are adjustable relative to each other between a coplanar position and a noncoplanar position, and an adjustable stem 74 by which the height of the adjustable seat 62 is manipulated.

The adjustable stem 74 is shown seated in a collar 76 which is fixedly attached to the cross member 60, near the center thereof. The collar 76 includes an aperture 78 which may be aligned with one of a series of apertures 80 drilled or otherwise formed in the stem 74. A pin, or other similar implement known in the art (not shown) is inserted through aligned apertures 78 and 80 to secure the adjustable seat 62 at the desired height.

The seat member 70, as illustrated, is preferably horizontal in orientation and is securely attached (as by welding) to the top end of the adjustable stem 74. The second seat member 72 is hingedly attached to the first seat member 70, thereby allowing for adjustment of the two seat members 70 and 72 between a coplanar and a noncoplanar relationship. The hinged connection may be made by a bolt 82 which passes through aligned apertures, not shown, in both of the seat members 70 and 72 near the edges thereof. A corresponding nut, not shown, would secure the bolt 82 in place. The seat members 70 and 72 may be padded to ensure the comfort of a user.

Figure 4:
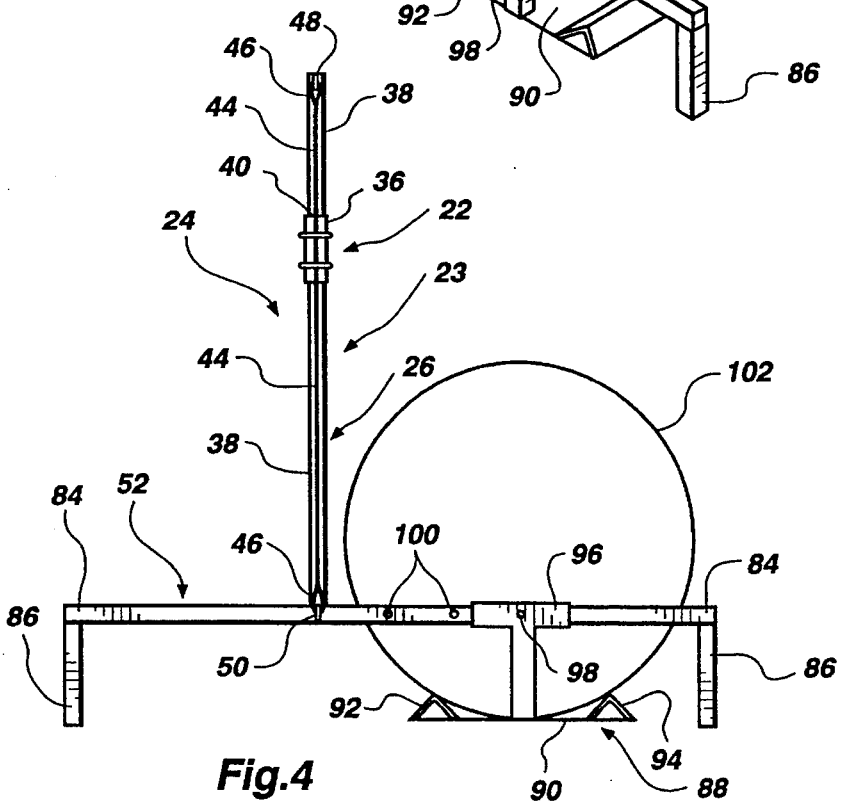
FIG. 4 is a side elevational view of the embodiment represented in FIG. 3 further illustrating the position of a typical wheelchair wheel.
Figure 5:
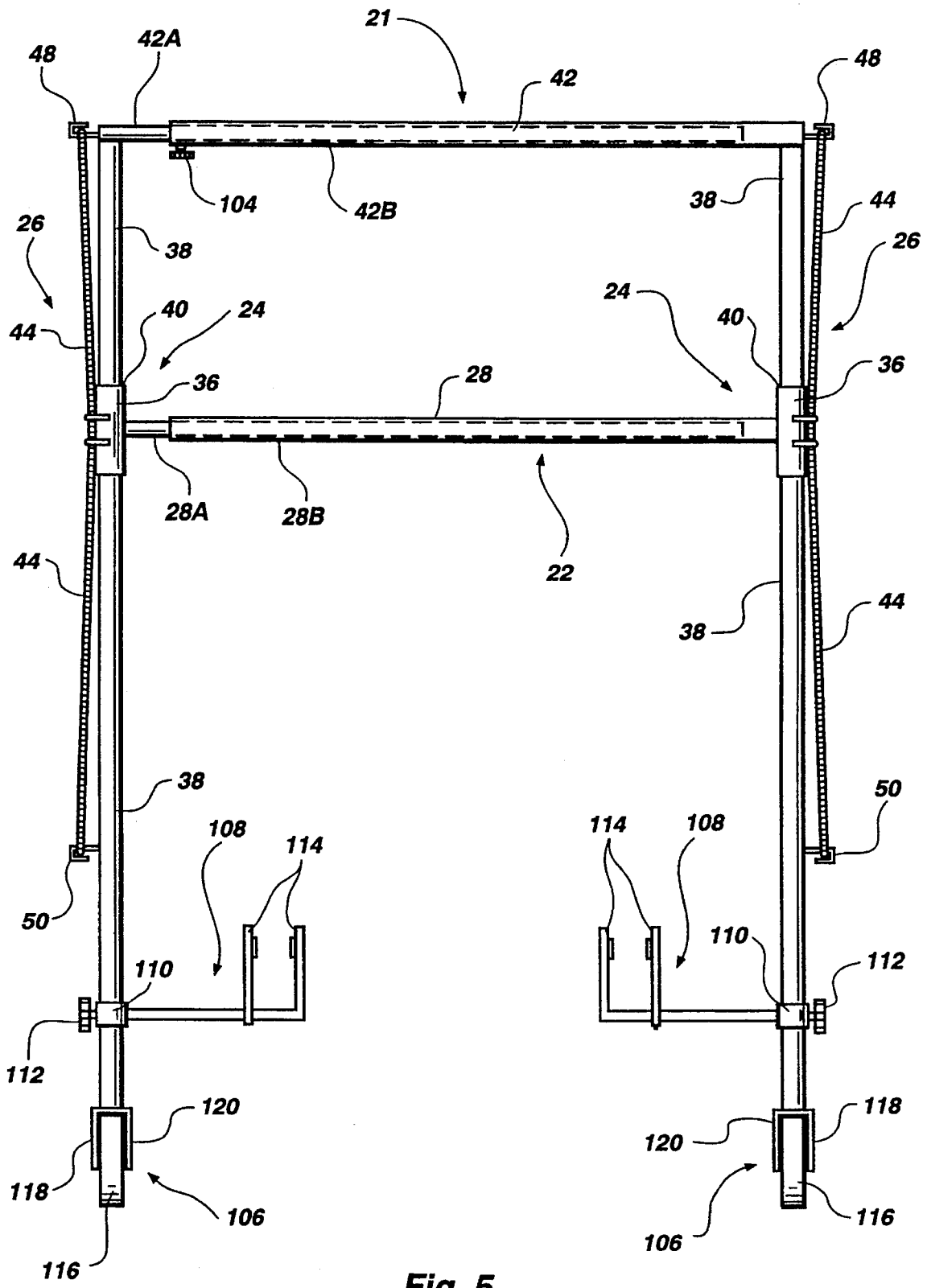
FIG. 5 is a front elevational view of still another preferred embodiment of the present invention specifically adapted for users confined to a bed.

An alternative embodiment of the present invention 23, which includes a modified base 52, is illustrated in FIGS. 3 and 4. The embodiment illustrated in FIGS. 3 and 4 is specifically adapted for operation by a user confined to a wheelchair. This embodiment includes a generally U-shaped frame portion 84, a supporting leg 86 disposed at each corner of the U-shaped frame portion 84 and another adjustable positioned assembly 96. The frame portion 84 and the supporting legs 86 are nearly identical to the frame portion 54 and supporting legs 56 of the embodiment of FIGS. 1 and 2, except that the frame portion 84 does not form a complete rectangle. One of the members of the frame portion 84 is absent to allow access to the adjustable positioned assembly, generally indicated at 88, by a wheelchair.

As illustrated in FIGS. 3 and 4, the adjustable positioned assembly 88 comprises a platform 90 which includes angle irons 92 and 94 welded or otherwise attached to the longitudinal edges thereof and T-shaped sleeves 96 by which the platform 90 is slidably mounted to opposing members of the frame portion 84. The platform 90 is formed of a rigid plate material, for example metal, fiberglass, or a composite or some other synthetic material, and disposed so as to rest on the surface supporting the apparatus 23. The angle irons 92 and 94 are also preferably formed of a rigid and durable material. The sleeves 96 are similar to the sleeves 64 of the embodiment shown in FIGS. 1 and 2, except that each is connected to the platform 90 which accommodates a wheelchair, rather than to the crossbar 60 upon which the adjustable seat 62 is mounted. Each sleeve 96 is fixedly attached to the platform 90.

The sleeves 96 function similarly to the sleeves 64 in that each sleeve 96 has an aperture 98, preferably identical to the aperture 66 (FIGS. 1 and 2), and is aligned with one in a series of apertures 100 in the frame portion 84, preferably identical to the series of apertures 68 (FIGS. 1 and 2) in the frame portion 54. Thus, as represented in FIG. 4, a wheelchair (not completely illustrated) having a wheel 102, is positioned on the platform 90 and the angle irons 92 and 94 prevent movement thereof during use and the sleeves 96 make the position of the platform 90 adjustable relative to the rigid bar 28.

Referring now to FIG. 5, another embodiment of the present invention, generally indicated at 21, is shown. The embodiment illustrated in FIG. 5 is particularly intended for connection to a hospital bed or the like. In this embodiment, the bar 28 and the crossbar 42 each comprise two separate telescoping members (28A-B and 42A-B, respectively), the crossbar 42 including a screw 104 for securing the telescoping members in the desired position. In this manner, the apparatus 21 can be adjusted to fit beds having differing widths.

Also, in the embodiment represented in FIG. 5, the parallel posts 38 are extended and include at the bottom portions thereof wheel assemblies, generally indicated at 106, to assist in transporting the apparatus 21 to and from the bed. Each post 38 further includes adjustable clamps, generally designated at 108, by which the apparatus 21 may be temporarily connected to the frame of the bed in which the user is confined.

As shown in FIG. 5, the clamps 108 include a collar 110 which can be adjustably positioned along the length of the post 38 by a screw 112, and a set of receiving jaws 114. The receiving jaws 114 have a standard locking mechanism, not shown, by which the jaws 114 are locked into a fixed position about the frame of the bed. The wheel assembly 106 is common in the art and may include a wheel 116 rotatably mounted between parallel arms 118 and 120, an axle, not shown, passing through both arms 118 and 120, as well as through the center of the wheel 116. It may be desirable to include a pair of wheels or casters in place of wheels 116 so that the apparatus 21 will be free standing for transport and storage. In this embodiment, the bottom hook 50 which secures the bottom portion of the cord 44, is fixedly attached to the bottom portion of the post 38.

Because of the tautness of the cord 44, movement of the means 22 for receiving a body extremity responsive to a force applied thereto should not exceed a few inches in either direction of the resting position. In this manner, a user properly positioned adjacent to the means for receiving (22), grasps or otherwise contacts the means for receiving (22) and exerts a force thereon utilizing one or more muscle groups. The position of the user and the position of the adjustable seat 62 (FIGS. 1 and 2) determine the muscle group or groups to be involved.

Because of the nature of the means used in the present invention for providing resistance, only slight movement preferably results from application of the force by a body extremity or other body part. Still, such movement prevents classification of the apparatus as a strictly isometric device. However, the full range of motion of which the user is capable is also prevented, thus preventing classification of the apparatus as strictly isotonic. Rather, the apparatus effectively combines both of these principles to provide the advantages inherent in each.

Figure 5A:
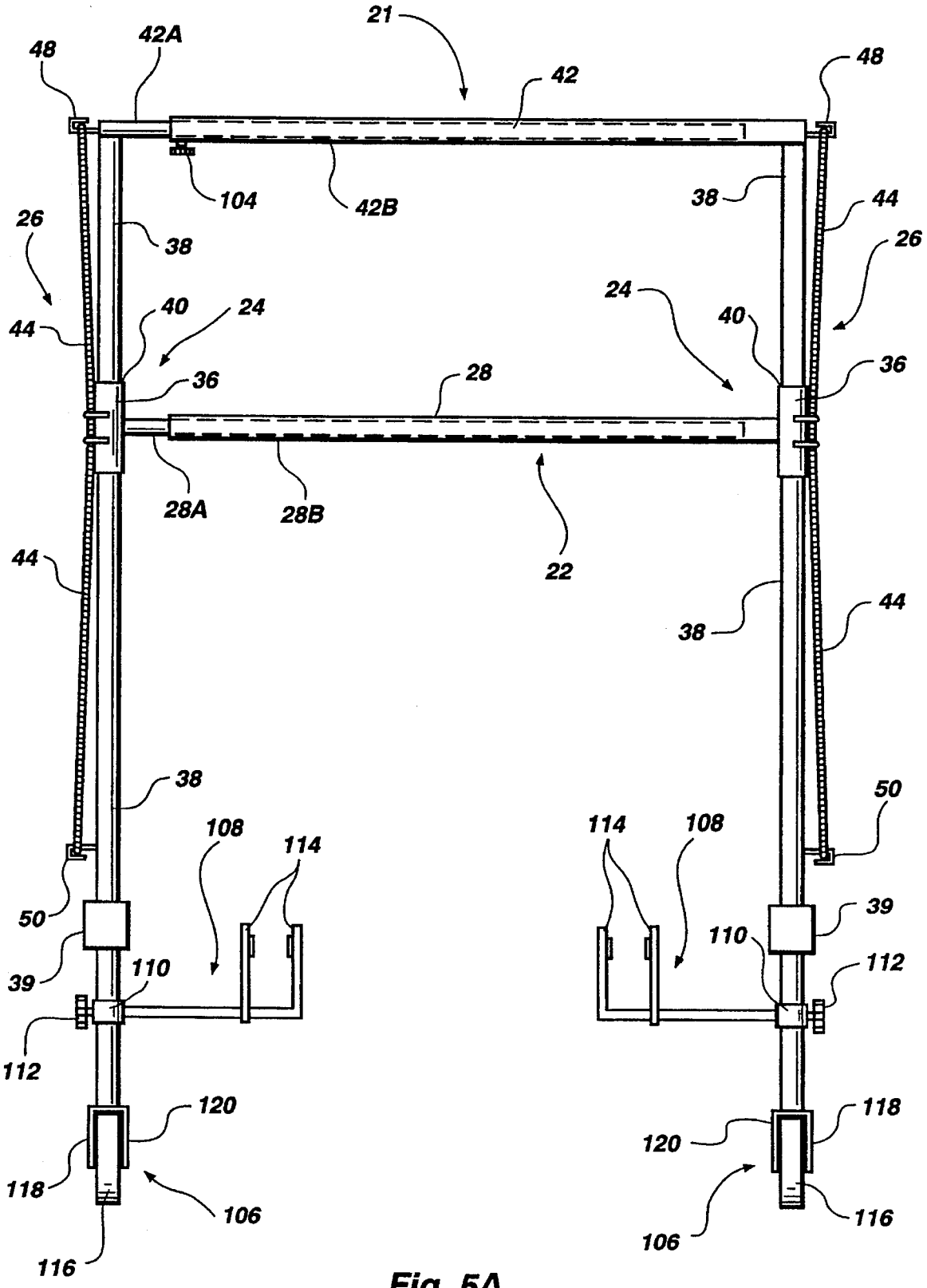
FIG. 5A is a front elevational view another embodiment of the present invention similar to the embodiment represented in FIG. 5 which includes a pivoting mechanism.

FIG. 5A illustrates another preferred embodiment of the present invention similar to the embodiment represented in FIG. 5 but which includes a pivoting structure, represented by the box 39, provided near the bottom of the post 38. A suitable mechanism for the pivoting structure 39 can readily be devised by those skilled in the art. Also, the pivoting mechanisms represented in 10–12 can be adapted for use with the embodiment of FIG. 5A.

Figure 10:
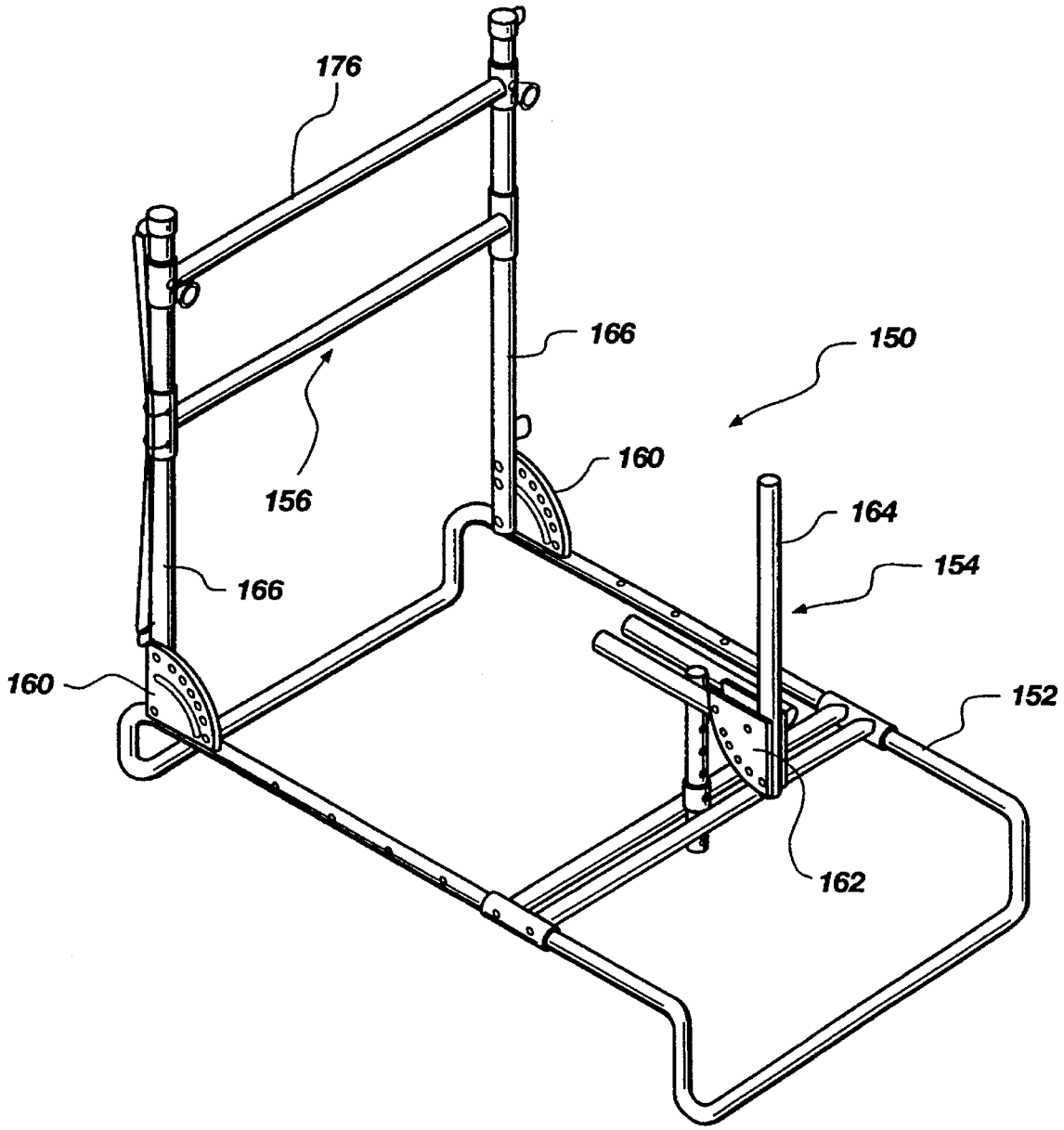
FIG. 10 is a perspective view of another embodiment of the present invention.
Figure 11:
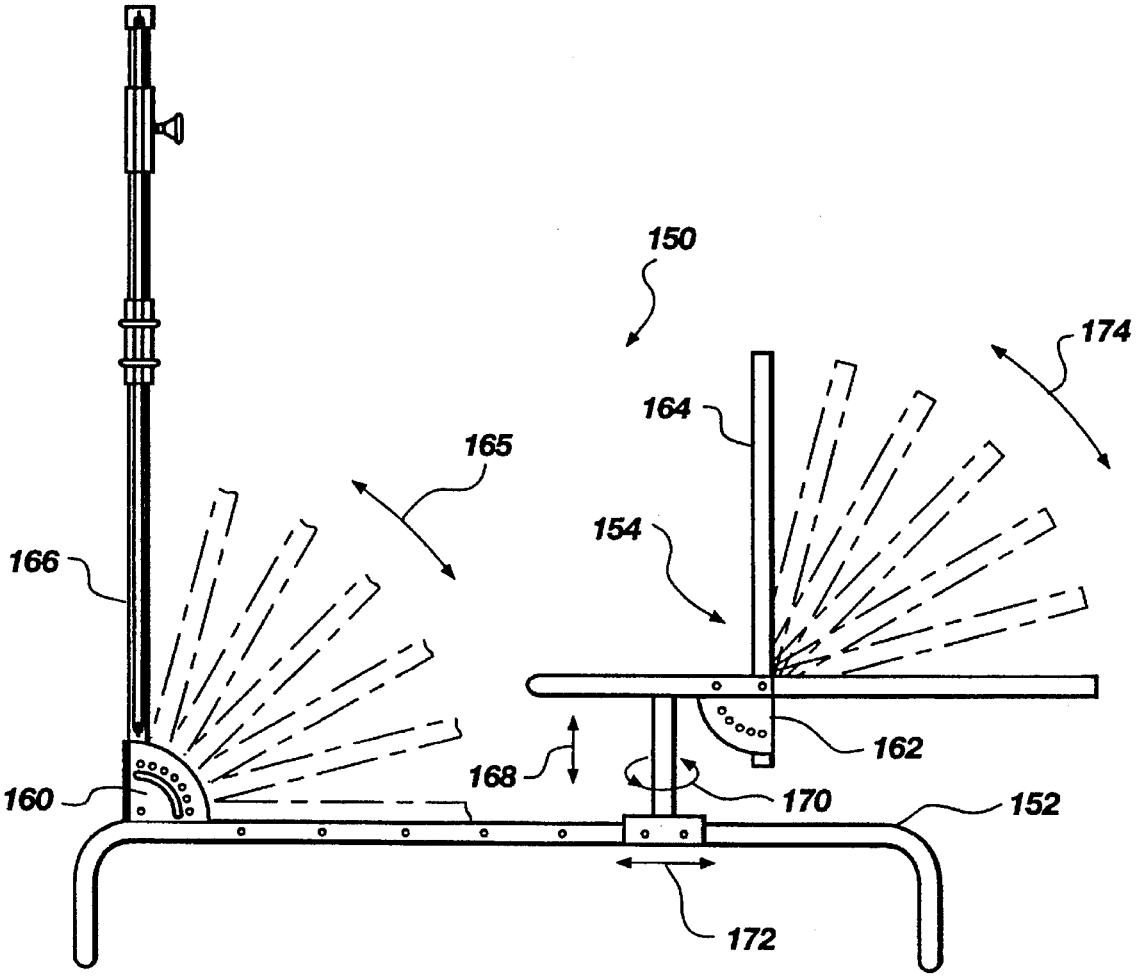
FIG. 11 is a side elevational view of the embodiment illustrated in FIG. 10.
Figure 12:
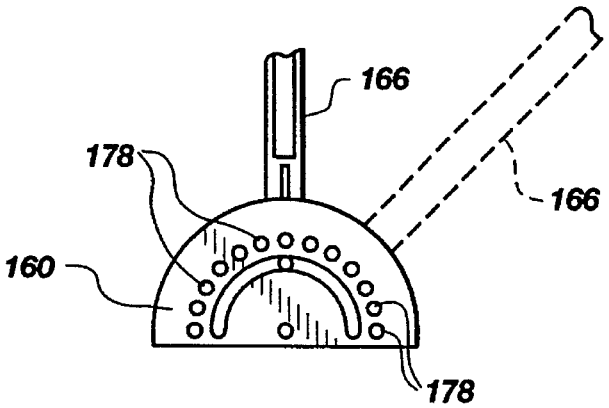
FIG. 12 is a detailed elevational view of a portion of the embodiment illustrated in FIG. 11.

FIGS. 10–12 illustrate another preferred embodiment of the present invention. The embodiment of FIGS. 10–12 shares the essential characteristics of the structures illustrated in FIGS. 1–9 with additional desirable structures added thereto. As will be appreciated, the structures represented in FIGS. 10–12 provide the important advantage of allowing the angular orientation of pertinent structures to be varied so that the relationship between the user's body and a rigid horizontal bar assembly, generally designated at 156, can be carefully selected and retained during exercise so that maximum benefit to the user can be obtained. It will be understood that selecting and retaining the proper relationship between the user's body and the bar assembly 156 is important to obtaining maximum benefit for the user by allowing a particular muscle group or groups to be exercised.

Referring now to FIG. 10, many of the illustrated structures are similar to those described in connection with FIGS. 1–9 and thus repetitious explanation will not be given here. Similarly to the earlier described structures, a frame 152 is provided. A seat support assembly is generally designated at 154. The seat support assembly 154 is the presently preferred arrangement for the means for supporting the user's body. The seat support assembly 154 is shown as a skeleton ready to receive, for example, upholstered pads (not illustrated).

The seat support assembly 154 can be adjustably positioned along the frame 152 in a manner similar to that described earlier herein in connection with cross bar 60 and sleeves 64 (FIGS. 1 and 2). The illustrated arrangement is the preferred structure for providing a means for adjusting the distance between the seat and the horizontal bar assembly 156.

A seat back support 164 is also provided with a pivoting structure 162 which allows the angular orientation of the seat back support 164 to be adjusted and held in place. Also, similarly to the function described earlier herein for the adjustable seat 62 (FIGS. 1 and 2), the height of the seat support assembly 154 can be adjusted using the illustrated means for adjusting the height of the seat support assembly. Furthermore, as will be explained more fully shortly, the seat support assembly 154 can also be rotated.

Also illustrated in FIG. 10 are two posts 166 which function to keep the movement of the horizontal bar assembly 156 in a predefined plane similarly to the earlier described corresponding structures. Desirably, pivoting structures 160 are provided to orient the predefined plane in which the horizontal bar assembly 156 moves in any one of a plurality of angular orientations. A crossbar 176 connects the two posts 166 together and assists with keeping the posts 166 parallel.

Referring next to the side elevational view of FIG. 11, the function of the pivoting structures is more particularly shown. As represented by the arrows provided in FIG. 11, the seat support assembly 154 can be adjusted vertically (arrow 168), rotated (arrow 172), and positioned horizontally (arrow 172). These adjustments allow the orientation of the seat support assembly 154 to be altered in three planes in relation to the horizontal bar assembly 156. Moreover, the pivoting structure 162 allows the seat back support 164 to be adjusted to any one of the plurality of angular positions in the plane represented by arrow 174.

Also represented in FIG. 11 is a pivoting structure 160 which allows the angular orientation of the posts 166 to be altered and held in any of a plurality of positions in the plane represented by arrow 165. FIG. 12 provides a detailed view of the pivoting structure 160 and the angular orientations provided thereby. The pivoting structures 160 and 162 are the preferred structures for carrying out the means for pivoting of the present invention. It is preferred that the illustrated pivoting structures 160 and 162 can usefully provide an angular range of anywhere from one-hundred and eighty degrees to fifteen degrees. It is most preferred that the pivoting structures 160 and 162 provide an angular range of ninety about degrees or about forty-five degrees.

Those skilled in the art will be able to devise alternative arrangements to carry out the function of pivoting structures 160 and 162. For example, pins of some kind may be inserted into bores 178 (identified in FIG. 12) of the pivoting structures 160 and 162 or some other arrangement can be used.

It will be appreciated that the angular adjustments for the seat assembly 154 and the posts 166 illustrated in FIGS. 10 and 11 provide even more flexibility and benefit for the user than if angular adjustment for just one component were provided. With the embodiment of the present invention represented in FIGS. 10–12, the orientation of the user's body in relation to the horizontal bar assembly 156 can be specifically adjusted and held in place.

Some embodiments of the present invention may have all, or just some, of the adjusting structures represented in FIGS. 10–12. Moreover, the structures represented in FIGS. 10–12 can be combined with those illustrated in FIGS. 1–9 to arrive at additional embodiments falling within the scope of the present invention.

Figure 13:
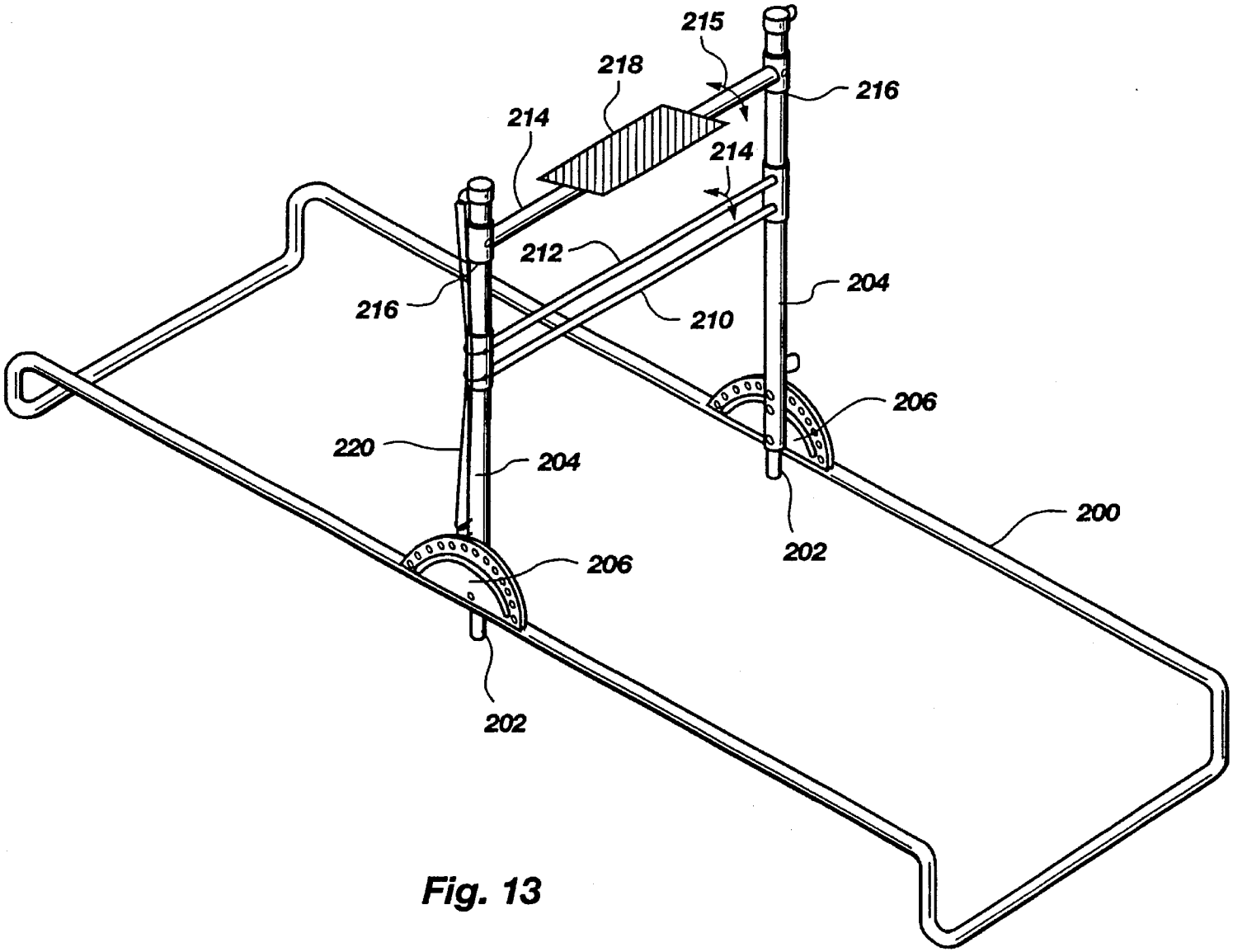
FIG. 13 is a perspective view of another embodiment of the present invention.

Reference will next be made to FIG. 13 which provides a perspective view of yet another preferred embodiment of the present invention. The embodiment of the present invention represented in FIG. 13 includes a frame 200 which can be fabricated in accordance with the same principles as applied with the earlier described embodiments. Also represented in FIG. 13 are two joints 202 which allow the frame 200 to fold upon itself for storage and/or transport which is a great advantage when the user must move the embodiment or if space is limited and the embodiment must be stored in a concealed location when not being used.

Also represented in FIG. 13 are two posts 204 which are connected to the pivoting structures 206. A sleeve 208 is provided on each post 204. Each sleeve 208 can slide along the length of the posts 204 in a fashion similar to that explained in the earlier described embodiments.

An upper bar 212 and a lower bar 210 are provided and are connected to sleeves 208 as indicated in FIG. 13. With both an upper bar 212 and a lower bar 210 connected to each sleeve 208, either bar can receive a body extremity of a user and the directional force provided by the body extremity. For example, the user may place one or both hands with palms facing downward toward lower bar 210 and the back of the hand facing the upper bar 212. In this way, the embodiment can resist the movement of the hand in when engaging in either extension or flexion movement without requiring the user to reposition the hand. Other body extremities can also be similarly accommodated.

The spacing between the upper bar 212 and the lower bar 210 can be fixed or structures can be provided to adjust the spacing to accommodate different body extremities. The upper bar 212 and the lower bar 210 can each be provided with appropriate padding and are preferably mounted in the sleeves 208 so that one or both can rotate in the direction of arrow 214.

Also illustrated in FIG. 13 is a support bar 214 which is connected at each of its ends to tubes 216 which are each provided with structure to adjustably hold the tubes 216, and thus the support bar 214, at one of many possible positions along the length of the posts 204. Also provided on the support bar 214 is an extremity rest 218. The extremity rest 218 is mounted so it can rotate about the support bar 218 in the direction of arrow 215. The extremity rest 218 is particularly useful for supporting the forearm of a user (not represented) as the user curls the fingers of one or both hands, and places said fingers from the rearward side, between the upper bar 212 and the lower 210 and engaging in exercise of said fingers. The position of the support bar 214, and the position and orientation of the extremity rest 218, can be adjusted to accommodate different users and different body extremities.

The flexible cord 220 provides resistance to movement of the upper bar 212 and the lower bar 210. Other structures can also be used to resist the movement of the upper bar 212 and the lower bar 210. The embodiment represented in FIG. 13 can be fabricated in a size for use on a table top and used for conditioning or rehabilitation of a user's hand and wrist. The embodiment of FIG. 13 can be readily adapted for other applications as will be appreciated by those skilled in the art using the information set forth herein.

Figure 13A:
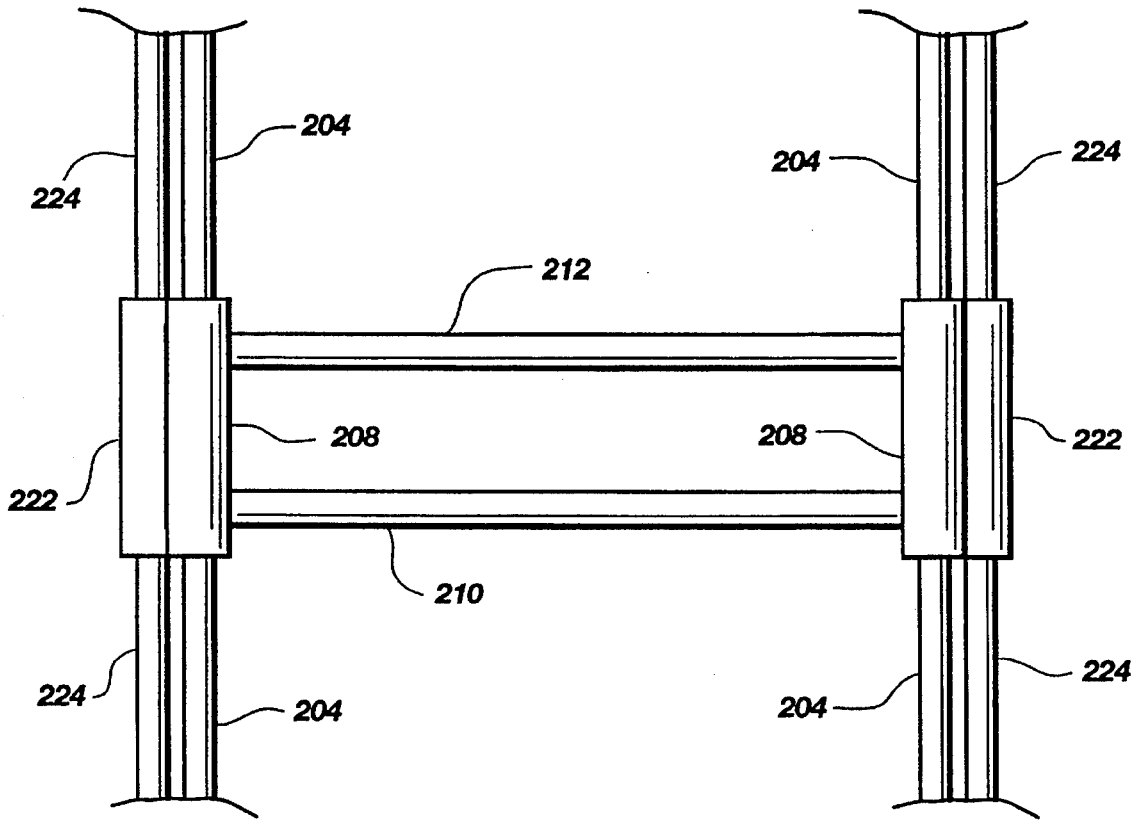
FIG. 13A is an end view of a portion of another embodiment of the present invention.

Reference will next be made to FIG. 13A which is a detailed view of a portion of another embodiment of the present invention. Represented in FIG. 13A are two posts 204, two sleeves, an upper bar 212 and a lower bar 210 all of which function similarly to the corresponding structures represented in FIG. 13. In contrast to the embodiment of FIG. 13, resistance to the movement of the body extremity is not provided by the flexible cord 220, but rather by two air cylinders 222. The air cylinders 222 can be the same or similar to those explained earlier and can be selected by those skilled in the art from the devices available in the industry.

The body of the air cylinders 222 is preferably attached to the sleeves 208 and pistons 224, protruding from each end of the air cylinders 222, are attached at their ends to the posts 204 or the frame (not illustrated in FIG. 13A) of the embodiment. It will be appreciated that many different pneumatic devices can preferably be used with the embodiments of the present invention. Importantly, the preferred air cylinders provide a unitary device which provides resistance in both directions of travel. The amount of resistance can be readily adjusted and accurately controlled. Moreover, the preferred air cylinders are durable and reliable. Those skilled in the art will appreciate that embodiments of the present invention can be devised which require only a single air cylinder 222 while it is preferred to provide two air cylinders 222 to provide the function of generating a resistance to the movement of a user's extremity.

Figure 14:
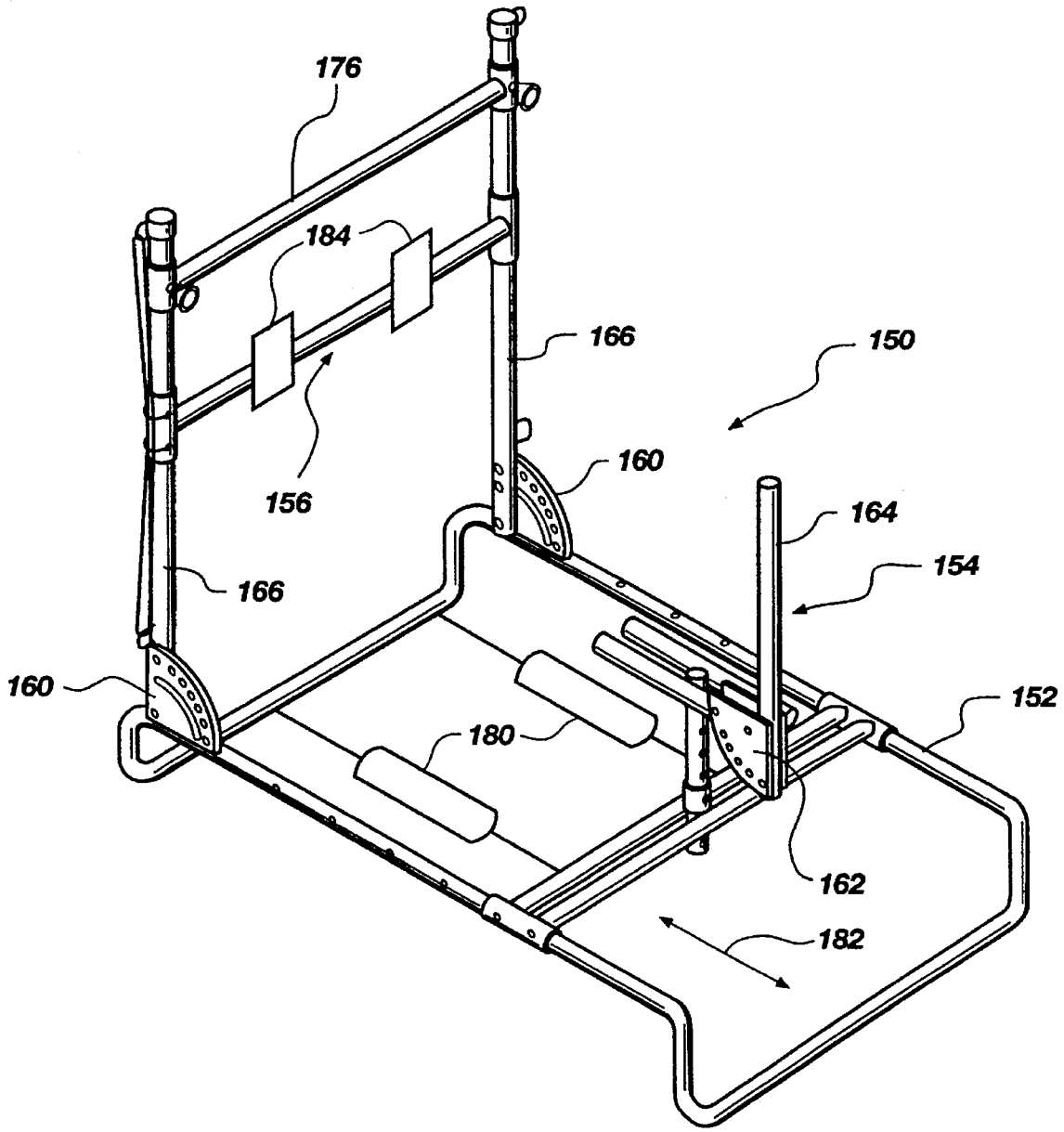
FIG. 14 is a perspective view of yet another embodiment of the present invention.

Reference will next be made to FIG. 14 which is a perspective view of another preferred embodiment of the present invention. The embodiment of the invention illustrated in FIG. 14 is similar to the embodiment represented in FIGS. 10–12 but with the inclusion of additional structures and desirable features.

As represented in FIG. 14, a pair of air cylinders 180 are connected between the seat assembly 154 and a member of the frame 152. Thus, as the user rests on the seat assembly 154, the user's legs or arms, which engage the horizontal bar assembly 156, can be exercised by sliding the seat assembly 154 along the frame 152 in the directions indicated by arrow 182 for an additional exercise accommodated by the present invention. It will be appreciated that the horizontal bar assembly 156 illustrated in FIG. 14 can be provided with extremity holding devices, represented by boxes 184 as can be devised by those skilled in the art, which can be used to hold the extremity of the user in place. The upper bar 212 and the lower bar 210, both represented in FIG. 13, can also function as the structure for receiving a body extremity in the embodiment illustrated in FIG. 14.

Those skilled in the art will appreciate that the different features represented in the above described figures can be combined in many novel embodiments of the invention which have not been specifically described and which can be adapted to particular applications. It will be appreciated that the embodiments of the present invention provide advantages which are not available in any previously available devices. For example, the embodiments of the present invention can be adjusted such that maximal loading of the user's muscle occurs at any of the several points along its limited range of motion. Moreover, the embodiments of the present invention have great benefits when providing physical therapy for those who have suffered an injury or who have reduced capacity for exercise.

In contrast to the present invention are exercise devices in which the orientation of the device in relation to the user is fixed or in which the orientation can only be adjusted by moving the user's body. Even further, it will be appreciated that the present invention provides significant advantages over devices which utilize structures such as weights or mechanical springs for providing resistance to the movement of the user's extremity.

The present invention may be embodied in other specific forms without departing from its essential characteristics. The described embodiments are to be considered in all respects only as illustrative and not restrictive. The scope of the invention is, therefore, indicated by the appended claims rather than by the foregoing description. All changes which come within the meaning and range of equivalence of the claims are to be embraced within their scope.

What is claimed and desired to be secured by United States Letters Patent is:

1. An apparatus comprising frame means, means for receiving a body extremity of a user, said means for receiving a body extremity receiving a directional force provided by the body extremity, means for maintaining the means for receiving a body extremity in a predefined plane during movement in a first direction and in a second direction, the second direction opposing that of the first direction, both directions being contained within the predefined plane, the means for receiving a body extremity stopping at a resting position when not acted upon by the body extremity, means for pivotally holding the means for maintaining at an angular position in relation to the frame means, means for adjusting the resting position, within the predefined plane, of the means for receiving a body extremity in relation to the user's body, means for adjusting the resting position, in the direction of a plane which is non parallel to the predefined plane, of the means for receiving a body extremity in relation to the user's body, and means for providing resistance to movement in both the first direction and in the second direction upon application of the force to the means for receiving a body extremity in either the first direction or the second direction, said force resulting in less than full movement of the means for receiving a body extremity and such that the position of the means for receiving can be anthropometrically adjusted to suit different users and accommodate working different muscle groups and the position of the means for receiving can be adjusted such that maximal loading of at least one of said muscle groups can occur at any one of several points along the range of motion of said muscle group.

2. An apparatus as in claim 1 wherein the means for maintaining the means for receiving a body extremity in a predefined plane during movement is further for limiting movement of the means for receiving a body extremity to movement in one dimension.

3. An apparatus as in claim 2 wherein the means for maintaining the means for receiving a body extremity in a predefined plane during movement comprises at least one sleeve attached to the means for receiving a body extremity and a post upon which the sleeve is slidably mounted.

4. An apparatus as in claim 3 wherein the sleeve is cylindrical in shape and includes a hollow central portion, the post upon which the sleeve is slidably mounted passing through the central portion of the sleeve.

5. An apparatus as in claim 3 wherein the post is disposed vertically to provide a vertical range of motion.

6. An apparatus as in claim 1 wherein the means for pivoting the means for maintaining through an angular range of motion comprises means for pivoting the means for maintaining through an angular range of motion of at least forty-five degrees.

7. An apparatus as in claim 6 wherein the crossbar connects the two parallel posts together at the top portions thereof.

8. An apparatus as in claim 1 wherein the means for receiving a body extremity is a bar having two ends, both ends being securely attached to the means for maintaining the means for receiving a body extremity in a predefined plane during movement.

9. An apparatus as in claim 1 wherein the means for receiving a body extremity is at least one sling into which a body extremity may be inserted.

10. An apparatus as in claim 1 wherein the means for providing resistance to movement is formed of an elastic material.

11. An apparatus as in claim 10 wherein the means for providing resistance to movement further comprises a flexible cord in tension.

12. An apparatus as in claim 11 wherein the resistance to movement is determined by the diameter of the flexible cord.

13. An apparatus as in claim 3 wherein the post includes a top portion and a bottom portion, and wherein the means for providing resistance to movement comprises at least one flexible cord in tension, the cord comprising a first end, a second end, and a middle portion, such that the first end of the flexible cord is connected to the top portion of the post, the second end of the flexible cord is connected to the bottom portion of the post, and the middle portion of the flexible cord is connected to the sleeve.

14. An apparatus as in claim 1 further comprising structural means for supporting the means for maintaining the means for receiving a body extremity in a predefined plane during movement.

15. An apparatus as in claim 14 wherein the structural means comprises a self-supporting base.

16. An apparatus comprising frame means for providing a base which can contact an underlying surface, means for receiving a body extremity of a user, said means for receiving a body extremity receiving a directional force provided by the body extremity, means for maintaining the means for receiving a body extremity in a predefined plane during movement in a first direction and in a second direction, the second direction opposing that of the first direction, both directions being contained within the predefined plane, the means for receiving a body extremity stopping at a resting position when not acted upon by the body extremity, the means for maintaining comprising at least a first linear member and a second linear member, the first linear member and the second linear member being substantially parallel, means for pivotally holding the means for maintaining at any one of a plurality of angular positions in relation to the frame means, means for adjusting the resting position, within the predefined plane, of the means for receiving a body extremity in relation to the user's body, means for adjusting the resting position, in the direction of a plane which is non parallel to the predefined plane, of the means for receiving a body extremity in relation to the user's body, and means for providing resistance to movement in both the first direction and in the second direction upon application of the force to the means for receiving a body extremity in either the first direction or the second direction, the means for providing resistance to movement comprising at least one unitary resistance furnishing structure, said application of force resulting in only a limited movement of the means for receiving a body extremity and such that the position of the means for receiving can be anthropometrically adjusted to suit different users and accommodate working different muscle groups and the position of the means for receiving can be adjusted such that maximal loading of at least one of said muscle groups can occur at any one of several points along the range of motion of said muscle group.

17. An exercise apparatus as defined in claim 16 further comprising means for rotatably positioning the means for supporting the user's body.

18. An exercise apparatus as defined in claim 16 wherein the means for supporting the user's body comprises a seat.

19. An exercise apparatus for working one or more of a plurality of muscle groups in the human body the apparatus comprising frame means, means for receiving a body extremity of a user, said means for receiving a body extremity receiving a directional force provided by the body extremity, means for maintaining the means for receiving a body extremity in a predefined plane during movement in a first direction and in a second direction, the second direction opposing that of the first direction, both directions being contained within the predefined plane, the means for maintaining comprising at least a first linear member and a second linear member, the first linear member and the second Linear member being substantially parallel, the means for receiving a body extremity suspended between said first linear member and said second linear member stopping at a resting position when not acted upon by the body extremity, means for pivotally holding the means for maintaining at any one of a plurality of angular positions in relation to the frame means, the plurality of angular positions being in the range from about one-hundred and eighty degrees to about fifteen degrees, means for adjusting the resting position, within the predefined plane, of the means for receiving a body extremity in relation to the user's body, means for supporting the user's body, the means for supporting the user's body comprising means for supporting the user's buttocks means for supporting the user's back and means for pivoting the means for supporting the user's back such that the angular orientation between the means for supporting the user's back and the means for supporting the user's buttocks can be adjusted, means for adjusting the height of the means for supporting the user's body in relation to the frame means, means for adjusting the distance between the means for supporting the user's body and the means for receiving a body extremity of a user, and means for providing resistance to movement in both the first direction and in the second direction upon application of the force to the means for receiving a body extremity in either the first direction or the second direction, the means for providing resistance to movement comprising a unitary resistance furnishing structure, said force resulting in only a limited movement of the means for receiving a body extremity and such that the position of the means for receiving can be anthropometrically adjusted to suit different users and accommodate working different muscle groups and the position of the means for receiving can be adjusted such that maximal loading of at least one of said muscle groups can occur at any one of several points along the range of motion of said muscle group.

20. An exercise apparatus as defined in claim 19 wherein the means for supporting the user's body comprises a seat and further comprising means for rotatably positioning the seat.

21. An apparatus as in claim 1 wherein the resting position is the same as a beginning position of the means for receiving a body extremity.

22. An apparatus as in claim 1 wherein the resting position is different than a beginning position of the means for receiving a body extremity.

* * * * *